US006447666B1

(12) United States Patent
Szameitat

(10) Patent No.: US 6,447,666 B1
(45) Date of Patent: Sep. 10, 2002

(54) GALVANIC BATH, METHOD FOR PRODUCING STRUCTURED HARD CHROMIUM LAYERS AND USE THEREOF

(75) Inventor: Klaus Szameitat, Leinfelden-Echterdingen (DE)

(73) Assignee: MAN Roland Druckmashinen AG (DE)

( * ) Notice: Subject to any disclaimer, the term of this patent is extended or adjusted under 35 U.S.C. 154(b) by 0 days.

(21) Appl. No.: 09/701,530

(22) PCT Filed: Jun. 21, 1999

(86) PCT No.: PCT/EP99/04412

§ 371 (c)(1), (2), (4) Date: Mar. 7, 2001

(87) PCT Pub. No.: WO00/00672

PCT Pub. Date: Jan. 6, 2000

(30) Foreign Application Priority Data

Jun. 26, 1998 (DE) ..... 198 28 545

(51) Int. Cl.[7] ..... C25D 3/10; C25D 11/02; C25D 5/18; C23C 18/00

(52) U.S. Cl. ..... 205/290; 205/179; 205/102; 106/1.25

(58) Field of Search ..... 205/290, 179, 205/102; 106/1.25

(56) References Cited

U.S. PATENT DOCUMENTS

| | | | | |
|---|---|---|---|---|
| 3,506,548 | A | 4/1970 | Duchene | 204/49 |
| 4,588,481 | A | 5/1986 | Chessin et al. | 204/51 |
| 4,619,742 | A | 10/1986 | Pliefke | 204/34 |
| 5,176,813 | A | 1/1993 | Newby | 205/284 |
| 5,415,761 | A | 5/1995 | Müll | 205/104 |

FOREIGN PATENT DOCUMENTS

| | | |
|---|---|---|
| DE | 34 02 554 | 8/1985 |
| DE | 42 11 881 | 10/1993 |
| DE | 44 32 512 | 3/1996 |
| EP | 0 722 515 | 1/1998 |

*Primary Examiner*—Edna Wong
(74) *Attorney, Agent, or Firm*—Leydig, Voit & Mayer, Ltd.

(57) ABSTRACT

The present invention relates to a galvanic bath, to a process for the precipitation of chromium onto objects, and to the use of the process for the generation of textured hard-chrome layers on machine components. The galvanic bath contains in aqueous solution at least one compound delivering chromium(VI)-ions, and it comprises a) chromium (VI)-ions in an amount that corresponds to 100 to 600 g/ltr of chromic acid anhydride, b) sulfate ions in the form of sulfuric acid and/or of a soluble salt thereof in a molar concentration ratio of chromium(VI)-ions to sulfate ions ($SO_4^{-2}$) ranging from 90:1 to 120:1, and c) 2-hydroxyethane sulfonate ions in an amount that corresponds to 0.01 to 3.0 g/ltr of the sodium salt.

17 Claims, 2 Drawing Sheets

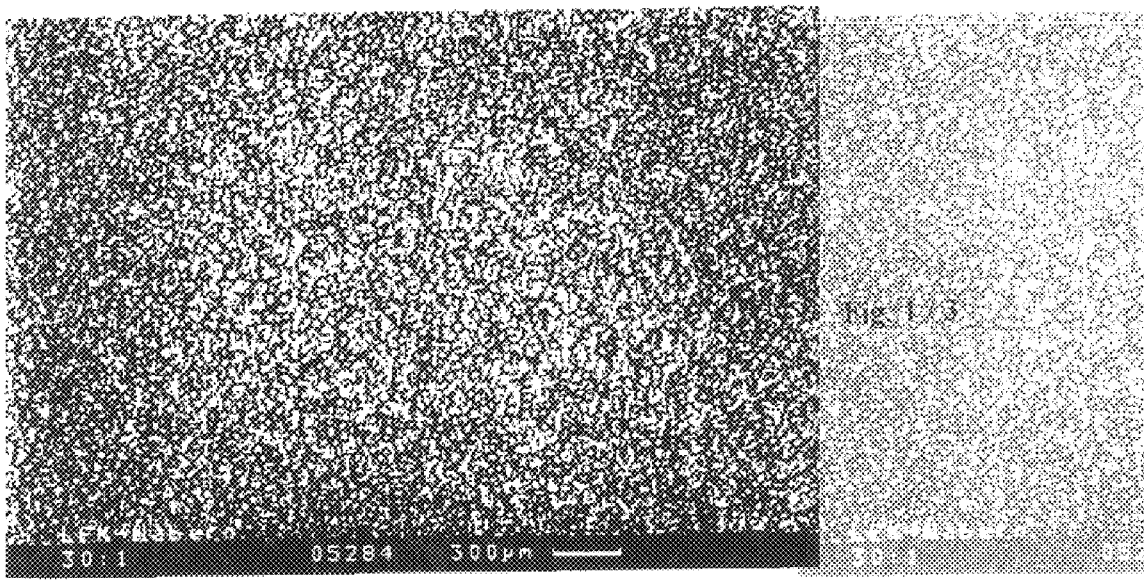
Fig. 1/3
30:1
05284
300µm
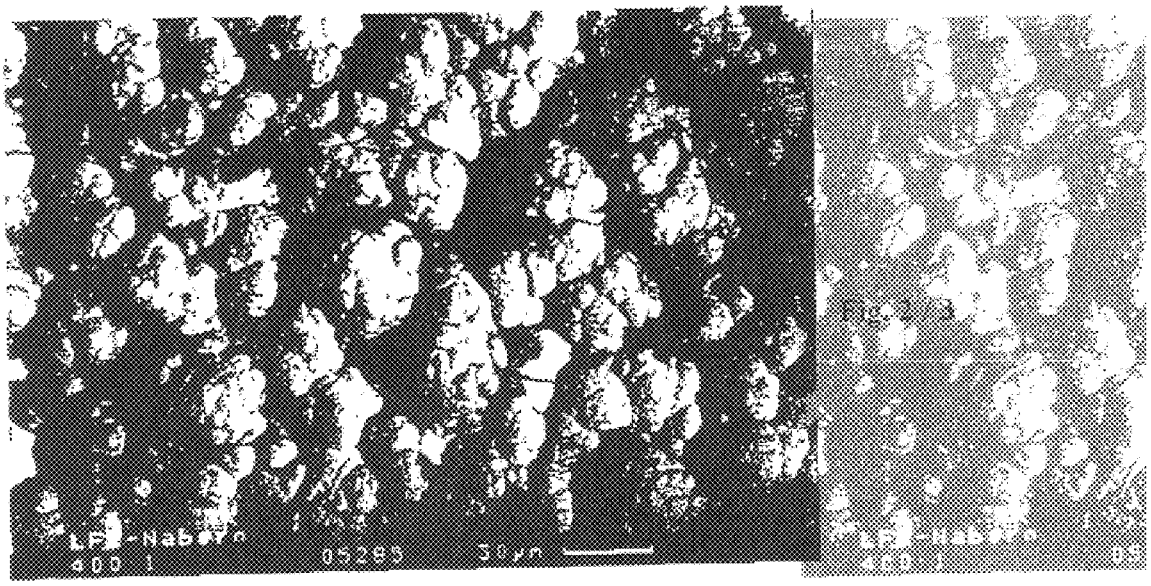
Fig. 2/3
LPJ-Nabern
300:1
05283
30µm

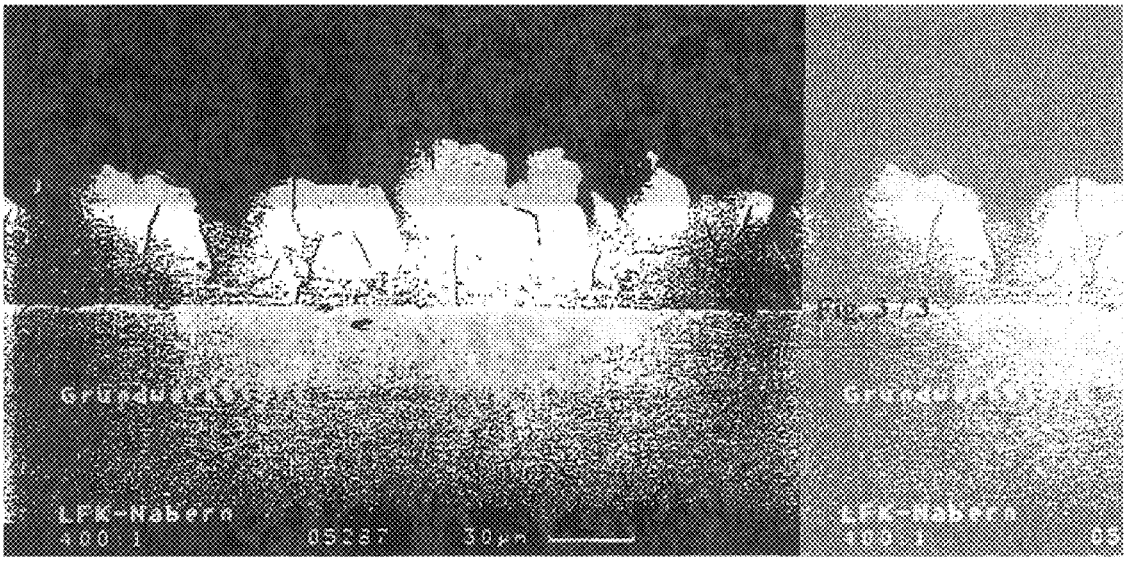
LPM-Nabero
400 1
05287
30µm
LPM-Nabero

GALVANIC BATH, METHOD FOR PRODUCING STRUCTURED HARD CHROMIUM LAYERS AND USE THEREOF

TECHNICAL FIELD OF THE INVENTION

The present invention is in the field of galvanic coating processes, and generally relates to a galvanic bath and to a process for the generation of textured hard-chrome layers on surfaces.

BACKGROUND OF THE INVENTION

It has long been current state of the art to provide objects with surface coatings by means of galvanic processes in order to impart to the objects special functional and/or decorative surface properties, such as hardness, corrosion resistance, metallic appearance, luster, or other properties. Galvanic baths that contain nickel or chromium serve in technical applications mostly for the generation of especially hard, mechanically resistant layers. In galvanic surface coating processes, the metal to be precipitated is provided in a bath in the form of a dissolved salt. The metal is deposited by means of direct current onto the object to be coated which is connected to a cathode. The object to be coated consists as a rule of a metallic material. When this is not the case, and when the object is not electrically conductive, then the surface of the object can be made conductive, for example, by a thin metallization.

In certain cases it is requisite or desired that objects that are provided with a galvanically generated hard-chrome layer present a "rough" surface texture. In decorative coatings, for example, it may be desired to imprint a matte appearance or an agreeable, non-smooth "feel." For technical applications, rough hard-chrome layers or textured-chrome layers have certain functional properties. For example, in machine components which stand in sliding contact with one another, such as, for example, pistons, cylinders, running sleeves, axle bearings, and so forth, rough hard-chrome layers are advantageous, since the texture causes lubricant deposits, thus preventing a dry-running. In the graphics industry, for sheet-guiding drums in printing presses, for example, inking rollers and dampening rollers with a rough surface are needed. Similarly, in the shaping and bending fields, texturally chromed tools can be used in order to impart a textured surface to the work-piece to be processed.

According to conventional techniques, objects with hard-chrome coating and rough surface texture are obtained by mechanical processing, such as grinding, sandblasting, spark erosion, etc., or by chemical etching processes before, between, or after the chroming. Such processes, however, are complicated and expensive by reason of the large number of requisite different working techniques.

From DE 42 11 881 there is known a galvanic process for applying surface coatings to machine components, in which, for example, chromium is precipitated in textured form. Here by at least one initial, and at least one subsequent voltage or current impulse, as well as by a certain conducting of the voltage or current function, there is first brought about a nucleation on the surface of the machine component, and subsequently growth of the nuclei of the precipitation material is caused. The chromium is precipitated in the form of statistically uniformly distributed dendritic- or approximately hemispherical- (cap-shaped) raised parts. Another reference, EP 0 722 515, contains a further development of the process according to DE 42 11 881 in which the increase of the electrical voltage or of the current density occurs in stages.

The forgoing references disclose the use of conventional galvanic baths. In DE 34 02 554 C2 it is proposed to use a saturated sulfonic acid with at most two carbon atoms and at most six sulfonic acid groups or salts or halogen acid derivatives thereof to increase the current yield in the galvanic precipitation of hard-chrome on a work-piece of steel or aluminum alloy from an aqueous non-etching electrolyte containing chromic acid and sulfuric acid. Another document, U.S. Pat. No. 5,176,813 discloses a process for the galvanic precipitation of chromium from a galvanic bath with a lead-containing anode in the absence of monosulfonic acid, in which the galvanic bath contains chromic acid, sulfate ions and at least one halogenated alkyl polysulfonic acid or its salt with 1 to 3 carbon atoms.

Known processes in which textured chrome layers are galvanically generated suffer from disadvantages. They demand a complicated multi-layer layer-construction, in which, before the textured chrome layer proper is applied, a nickel strike-layer is first applied onto the base material of the component, then a thicker sulfate nickel layer, followed by the chrome layer, and last of all a covering with a fissure-poor hard-chrome layer. These different layers require specific, differently composed galvanic baths and different precipitation conditions, adjusted in each case to the particular layer to be deposited. The conducting of the process is therefore costly, complicated and, by reason of the necessary working steps, very cost-intensive. Further, there are obtainable via such processes only layers with roughness values Rz of up to about 10$\mu$. Moreover, the uniformity of the distribution and the formation of the cap-shaped raised parts is still in need of improvement.

It is a general object of the present invention to substantially simplify the generation of textured hard-chrome layers and, in particular, to make possible textured layers with more uniform surface topography and substantially higher roughness values.

SUMMARY OF THE INVENTION

It has now been found that textured hard-chrome layers corresponding to the foregoing general object can be obtained from a galvanic bath that contains at least one chromium (VI)-ion delivery compound and is characterized in that it contains the following:

a) Chromium(VI)-ions in an amount that corresponds to 100 to 600 g/ltr of chromic acid anhydride;

b) Sulfate ions in the form of sulfuric acid and/or of a soluble salt thereof in a molar concentration ratio of chromium(VI)-ions to sulfate ions ($SO_4^{-2}$) of 90:1 to 120:1, and c) 2-hydroxyethane sulfonate ions in an amount to corresponds to 0.01 to 3.0 g/ltr of the sodium salt.

It has been found, surprisingly, that the inventive combination of the components sulfate and 2-hydroxyethane sulfonate results in especially advantageous properties of the chrome bath.

BRIEF DESCRIPTION OF THE DRAWINGS

FIG. 1 shows the SEM exposure of the surface of the roller cylinder treated by way of example with the chrome bath of the invention and texturally chrome-plated according to the process of the invention, with an enlargement of 30:1. The dense and uniform distribution of the spherical cap-shaped raised areas is clearly evident.

FIG. 2 shows a cutout from this zone with an enlargement of 400:1, in which the topography of the structure is clarified.

FIG. 3 shows the SEM exposure of a cross section through the layer with an enlargement of 400:1.

DETAILED DESCRIPTION OF THE PREFERRED EMBODIMENTS

Generally, the galvanic bath includes chromium(VI)-ions, sulfate ions and 2-hydroxyethane sulfonate. With regard to chromium (VI)-ions, preferably the galvanic bath according to the invention contains chromium(VI)-ions in an amount that corresponds to 200 to 250 g/ltr of chromic acid anhydride. The compound delivering chromium(VI) ions is preferably selected from chromic acid anhydride ($CrO_3$) and/or alkali dichromates such as $Na_2Cr_2O_7$ and $K_2Cr_2O_7$. Of the alkali dichromates, $K_2Cr_2O_7$ is preferred. In an especially preferred embodiment the source of chromium(VI)-ions is chromic acid anhydride. In a further embodiment, a part of the source of chromium (VI)-ions includes one or more alkali dichromate(s), preferably potassium chromate. In this embodiment, preferably less than 30%, and more preferably less than 15%, of the chromium(VI)-ions are delivered by alkali dichromate.

With regard to sulfate ions, the molar concentration ratio of chromium(VI)-ions to sulfate ions in the galvanic bath amounts preferably to 100:1 to 105:1. The usable soluble salts of sulfuric acid are preferably selected from sodium sulfate, potassium sulfate, lithium sulfate, ammonium sulfate, magnesium sulfate, strontium sulfate, aluminum sulfate and potassium aluminum sulfate. Strontium sulfate is especially preferred.

The 2-hydroxyethane sulfonate ions contained in the galvanic bath of the invention can be provided by 2-hydroxyethane sulfonic acid itself or a salt thereof, preferably the sodium salt. In a preferred embodiment, the bath comprises 2-hydroxyethane sulfonate ions in an amount that corresponds to 0.07 to 1.5 g/ltr of the sodium salt.

The galvanic chrome bath of the invention can be used in the electroplating installations ordinarily used in this technology and with the conventional manners of operation as well as for conventional coating purposes and on conventional objects to be coated. Such objects can be, for example, objects of conductive materials such as metal, especially steel, and metallized nonconducting objects.

The galvanic bath of the invention is purposefully used at temperatures between 30° C. and 70° C. When the galvanic precipitation from such a bath is performed at a temperature of ≦50° C. then chrome layers can be generated with a maximally uniform cup-shaped microstructure, and roughness values Rz of up to about 40$\mu$. Such a precipitation is preferably performed in the temperature range of 40 to 50° C., preferably between 42 and 48° C., and especially preferably between 44 and 46° C.

When the galvanic precipitation from such a bath is performed at a temperature of >50° C., then fissure-poor smooth chrome-layers can be generated. Such a precipitation is preferably performed in the temperature range between 51 and 61° C., preferably between 53 and 59° C. and especially preferably between 55 and 57° C.

In this manner, it is directly possible, according to the invention, to produce from one and the same chrome bath, by variation only of the bath temperature during the galvanic precipitation, a three-layered construction on the base object. Specifically, the object may be provided with a first layer comprising a fissure-poor smooth base layer, followed by a textured chrome-layer, and third by a fissure-poor smooth functional layer. With the chrome bath of the invention it is possible to perform the precipitation directly onto materials, such as steel. Galvanic pre-coatings, especially with nickel, are not required.

To deposit a textured hard-chrome layer on to an object, the object, connected to a cathode in a circuit, is brought into the galvanic bath of the invention. There it is sufficient if the object is ground to measure. A further surface treatment such as a galvanic pre-coating, is not required. For an especially uniform coating, it is advantageous to keep the bath in continuous circulation and/or to keep the object to be coated in continuous rotation in the bath.

The process of the invention can be carried out in the following manner:

In a first step a ground layer is precipitated in the form of a smooth fissure-poor chrome layer at a temperature in the range from 50 to 70° C., preferably from 51 to 61° C. especially preferably from 53 to 59° C. and, most preferably, from 55 to 57° C. The current density can amount here to up to 50 A/dm$^2$. With a precipitation time (TP) of 10 to 15 minutes there can be achieved here a base-layer thickness of 6–9$\mu$. Expediently, before the beginning of the precipitation, there is set in a waiting time (TW), during which time the object takes on the temperature of the bath. This time, depending on the size of the object and the temperature difference, can amount to 1 to 10 minutes. It is advantageous before the precipitation to set in an activation step, in which the object is positively poled. The current density here can amount to up to 30 A/dm$^2$. As time duration TP, 1 to 2 minutes are sufficient. The base-layer obtained has, as a rule, a micro-hardness of 800 to 950 HV 0.1.

In the second step there occurs the precipitation proper of the textured chrome layer from the same bath. For this the bath temperature is to be set at 30 to 50° C., preferably at 40 to 50° C., especially preferably at 42 to 48° C. and, most preferably, at 44 to 46° C. Also in this step it is expedient to set in an activation step with the already-mentioned parameters before the beginning of the precipitation. The precipitation occurs suitably with a current density of 75 to 90 A/dm$^2$. With a precipitation time TP of 10 to 30 minutes there can be achieved here a thickness of the textured layer of 14 to 40$\mu$. The textured layer obtained normally has a micro-hardness of 850 to 900 HV 0.1. The textured layer obtains a roughness Rz of up to about 40$\mu$.

In the third step, the textured chrome layer is coated with a thin, smooth hard-chrome layer, i.e. the functional layer, again from the same bath. For this, the bath is brought to a temperature in the range of 50 to 70° C., preferably of 51 to 61° C., especially preferably of 53 to 59° C., and most preferably of 55 to 57° C., and then the precipitation is carried out with a current density of up to 50 A/dm$^2$. With a precipitation time TP of 5 to 15 minutes there can be achieved here a layer thickness of the functional layer of 3 to 9$\mu$. The functional layer normally has a micro-hardness of 1000 to 1050 HV 0.1. By the closing thin hard-chrome layer the roughness of the textured layer is virtually not altered. In this step, too, it is again expedient before the beginning of the precipitation to insert a waiting time TW and an activation step with the already-mentioned parameters.

In all the precipitating steps it is further advantageous to provide before the respective precipitating times, a ramp time (TR), in which the current density is regulated to the corresponding value. The ramp time TR can in each case amount to 1 to 5 minutes.

The process is distinguished from processes according to the state of the art by an especially simple current density management. Thus, for the generation of a thin, uniform, well textured hard-chrome textured coating, it is sufficient, in the respective steps, directly and linearly to guide the increase and the decrease of the current density to the respective desired value. Hereby there are not needed the otherwise required, technically expensive, and therefore costly current and voltage regulating units and their involved programming. In certain cases, however, it can also be favorable and advantageous to regulate the current in stages to the maximal value, or downward again, in stages.

With this procedure there is obtained on the surface of the object a textured hard-chrome layer which is distinguished by an especially dense and uniform distribution of very well formed cup-shaped raised parts. There can be obtained a layer with a peak number of 75 to 100/cm. Depending on the choice of the precipitating conditions, especially in the step of the textured coating, there can be achieved roughness values Rz of up to 40$\mu$. The process of the invention can be used to generate a chrome layer on components, especially machine components. In a preferred embodiment the process is used to generate a textured hard-chrome layer on machine components standing in sliding contact with one another, in particular, pistons, cylinders, running sleeves and axle bearings on rollers, drums and cylinders of the graphic industry, especially inking rollers and dampening rollers and on tools.

The following Example is provided to illustrate the invention, but should not be construed as limiting the scope of the invention.

EXAMPLE

In this Example 100 ltrs of bath containing 20.450 kg of chromic acid anhydride, 2.500 kg of potassium dichromate, 0.550 kg of strontium sulfate and 3.5 g of 2-hydroxyethane sulfonic acid sodium salt were provided. From these there are yielded as concentration values in the bath 222 g/ltr of chromic acid anhydride, 2.2 g/ltr of free sulfate and 0.035 g/ltr of 2-hydroxyethane sulfonic acid sodium salt. For the textured chroming on the example of a roller cylinder made of steel S52 as base material from the ground material, there are chosen about the following process parameters:

| | |
|---|---|
| Precipitation of base layer (bath temperature 55 to 57° C.): | TW 5.0 min |
| Activation (30 A/dm$^2$) | TR 1.0 min |
| | TP 0.5 min |
| Precipitation (50 A/dm$^2$) | TR 2.0 min |
| | TP 10.0 min |
| Precipitation of textured layer (bath temperature 44 to 46° C.): | TW 0.5 min |
| Activation (30 A/dm$^2$) | TR 1.0 min |
| | TP 0.5 min |
| Precipitation (75 A/dm$^2$) | TR 3.0 min |
| | TP 10.0 min |
| | TW 3.0 min |
| Precipitation (80 A/dm$^2$) | TR 1.0 min |
| | TP 10.0 min |
| | TW 3.0 min |
| Precipitation (90 A/dm$^2$) | TR 1.0 min |
| | TP 10.0 min |
| Precipitation of functional layer (bath temperature 55 to 57° C.) | TW 3.0 min |
| Activation (30 A/dm$^2$) | TR 1.0 min |
| | TP 0.5 min |
| Precipitation (50 A/dm$^2$) | TR 2.0 min |
| | TP 10.0 min |

The structured chrome layer obtained has a roughness Rz of 35 to 40$\mu$, and a peak number of 75–100/cm, with an extremely uniform distribution of very well formed cap-shaped raised parts.

What is claimed is:

1. A galvanic bath comprising:

d) a compound delivering chromium(VI)-ions, said chromium(VI)-ions being present in an amount that corresponds to 100 to 600 g/ltr of chromic acid anhydride, e) sulfate ions in the form of sulfuric acid and/or of a soluble salt thereof in a molar concentration ratio of chromium(VI)-ions to sulfate ions ($SO_4^{-2}$) that ranges from 90:1 to 120:1, and f) 2-hydroxyethane sulfonate ions in an amount that corresponds to 0.01 to 3.0 g/ltr of the sodium salt thereof.

2. Galvanic bath according to claim 1, wherein chromium (VI)-ions are present in an amount that corresponds to 200 to 250 g/ltr of chromic acid anhydride.

3. Galvanic bath according to claim 1, wherein said compound is selected from the group consisting of chromic acid anhydride and an alkali dichromate.

4. Galvanic bath according to claim 1, wherein the molar concentration ratio of chromium(VI)-ions to sulfate ions ranges from to 100:1 to 105:1.

5. Galvanic bath according to claim 1, wherein the sulfate ions are present in the form of a compound selected from the group consisting of sulfuric acid, sodium sulfate, potassium sulfate, lithium sulfate, ammonium sulfate, magnesium sulfate, strontium sulfate, aluminum sulfate and potassium aluminum sulfate.

6. Galvanic bath according to claim 5, wherein the sulfate ions are present in the form of strontium sulfate.

7. Galvanic bath according to claim 1, containing 0.07 to 1.5 g/ltr of 2-hydroxyethane sulfonate, calculated as sodium salt.

8. A process for providing a coating on an object, the process comprising galvanically precipitating a chrome-containing coating onto said object from the galvanic bath according to claim 1.

9. Process according to claim 8, comprising the following steps:

a) Precipitating a ground chrome layer at a temperature of $\geqq$50° C., b) Precipitating a textured chrome layer at a temperature of $\leqq$50° C., and c) Precipitating a functional chrome layer at a temperature of $\geqq$50° C.

10. Process according to claim 9, wherein independently from one another the temperature in step a) is in the range between 51 and 61° C.; the temperature in step b) is in the range between 40 and 50° C.; and the temperature in step c) is in the range between 51 and 61° C.

11. Process according to claim 9, wherein independently from one another the precipitation of the ground chrome layer in step a) is at a current density of up to 50 A/dm$^2$; the precipitation of the textured chrome layer in step b) is at a current density of 75 to 90 A/dm$^2$; and the precipitation of the functional chrome layer in step c) is at a current density of up to 50 A/dm$^2$.

12. Process according to claim 9, wherein the rise and/or fall of a current density in steps a), b) and/or c) from the start value to the end value is linear.

13. Process according to claim 9, wherein the rise and/or fall of a current density in one or more of steps a), b) and/or c) from the start value to the end value is carried out in each case in steps.

14. Process according to claim 9, wherein independently from one another before one or more of steps a), b) and c) an activation is carried out with a current density of up to 30 $A/dm^2$, and wherein said object is positively polarized.

15. A process according to claim 9, wherein said object is a machine component.

16. A process according to claim 15, wherein said component is selected from the group consisting of sheet conducting cylinders and drums in the graphic industry.

17. A process according to claim 9, wherein said machine component is selected from the group consisting of pistons, cylinders, running sleeves, axle bearings, and rollers in the graphics industry.

* * * * *